US006895726B2

(12) United States Patent
Pinto et al.

(10) Patent No.: US 6,895,726 B2
(45) Date of Patent: May 24, 2005

(54) POLY-STRETCH BAGGER SYSTEM

(75) Inventors: Robert Pinto, Chicago, IL (US); Eggo L. Haschke, Deerfield, IL (US)

(73) Assignee: Poly-Clip System Corp., Mundelein, IL (US)

( * ) Notice: Subject to any disclaimer, the term of this patent is extended or adjusted under 35 U.S.C. 154(b) by 0 days.

(21) Appl. No.: 10/435,912

(22) Filed: May 12, 2003

(65) Prior Publication Data

US 2003/0202402 A1 Oct. 30, 2003

Related U.S. Application Data

(63) Continuation of application No. 10/046,143, filed on Jan. 15, 2002, now abandoned.
(60) Provisional application No. 60/261,969, filed on Jan. 16, 2001.

(51) Int. Cl.[7] ..... B65B 43/28
(52) U.S. Cl. ..... 53/384.1; 53/459; 53/469; 53/556
(58) Field of Search ..... 53/459, 469, 529, 53/570, 571, 573, 258, 384.1, 556; 493/218, 255, 258

(56) References Cited

U.S. PATENT DOCUMENTS 4,241,562 A * 12/1980 Meyer ..... 53/438
4,270,336 A * 6/1981 Altenpohl et al. ..... 53/493
5,692,360 A * 12/1997 McDonald et al. ..... 53/434

* cited by examiner

*Primary Examiner*—Rinaldi I. Rada
*Assistant Examiner*—Hemant M. Desai
(74) *Attorney, Agent, or Firm*—Trexler, Bushnell, Giangiorgi, Blackstone & Marr, Ltd.

(57) ABSTRACT

A bagger system for enclosing material very tightly in a plastic bag, to reduce packaging costs, present a pleasing appearance, decrease leaks, and minimize distortion of the printed information on the packaging. The system comprises a base guide to hold the material to be encased and stretching fingers to open a plastic bag. The rotational movement of the stretching fingers provides even stretching about the circumference of the bag and permits an approximation of the cross section of the material to be encased, allowing for use of a smaller bag. After the material is placed in the bag, the material and bag are ejected, whereupon the plastic bag retracts tightly around the material, presenting a pleasing appearance to consumers and minimizing distortion of any printed information on the bag.

27 Claims, 6 Drawing Sheets

POLY-STRETCH BAGGER SYSTEM

CROSS REFERENCE

This patent application is a continuation of U.S. application Ser. No. 10/046,143, filed Jan. 15, 2002, now abandoned which claims benefit of U.S. provisional application Ser. No. 60/261,969, filed Jan. 16, 2001.

FIELD OF THE INVENTION

This invention is generally directed to a system for encasing materials, such as poultry or other materials, in plastic bags.

BACKGROUND OF THE INVENTION

The poultry industry sells fowl either as whole dressed birds or as cut-up parts. A consumer can buy a whole dressed chicken in a grocery store, can buy one dressed chicken cut up into parts, or can buy a package of, for example, just legs or just wings. In the two latter situations, the chicken parts are placed on a disposable tray, typically styrofoam, in order to hold the parts together. Some poultry producers place whole dressed birds on these trays also.

The prior art method to encase the product is a heat-seal process. The tray and product are wrapped in a clear plastic material which is then exposed to heat, shrinking the wrapping material and sealing the package. The advantage to the heat-sealing process is that it wraps the product very tightly. In the case of products such as poultry, a tighter package presents a better appearance to consumers. There is an increased marketing advantage to more tightly wrapped packages. Accordingly, the tighter the package can be wrapped, the more advantageous the system.

The disadvantage to the heat-sealing system is that the heat-sealed packages tend to leak. The packaging for any material encased by this method that has any liquid will, sooner or later, leak that liquid. "Leakers" are a problem both for the sellers such as grocery stores and for consumers, as the leaked fluid must be cleaned from the display case, refrigerator, or anywhere else it spilled. Chicken blood in particular is a problem, as it may contain bacteria and must be cleaned quite thoroughly.

A solution to the leaking problem is to use plastic bags to encase the products. A plastic bag that is clipped provides a better sealed package than one subjected to the heat-sealing process. Clipped bags are accordingly less likely to leak.

It is difficult, however, to place an object, such as a chicken, in a bag the exact same size as the chicken. Using a bag larger than the chicken eases the bagging process. The larger bag detracts from the appearance of the package, however, as the chicken is not tightly wrapped. There is also an increased cost to using larger bags.

It is also difficult to place a tray containing a chicken or chicken parts into a bag, since the parts must remain upright until securely wrapped. It is also mechanically difficult to place material on a tray into a bag and also maintain a tight fit, because of the relatively rigid structure of the tray. The use of a larger bag eases the process of placing the loaded tray into the bag, but the material on the tray will then likely fall off the tray later, such as during loading or in transit, defeating the whole purpose of using a tray. Accordingly, trayed chicken, whether whole or cut-up parts, is generally not bagged in the poultry industry.

Additionally, marketers of products usually wish to display their trade names, trade dress, or logos on the packaging. Marketers sometimes also wish to display other information, such as warnings or instructions, on the packaging. It is less expensive to preprint the packaging material. Adding one or more labels after packing adds an extra cost. Printing directly onto the package after packing is very expensive. Accordingly, the use of preprinted packaging material is desired. Forcing a chicken or a tray of chicken parts into a very tight plastic bag, however, causes random distortion of the printing on the bag, disfiguring the preprinted information. Similarly, the heat-sealing process described above causes severe distortion of any printed information on the wrapping material.

Consequently, for heat-sealed packages, one or more separate labels must be used for any information such as brand identification or cooking instructions. This placement of separate labels, of course, adds an additional cost.

One method presently known to the poultry industry to preprint information on the packaging of whole dressed chickens is to use bags slightly larger than the average chicken. As described above, however, the use of larger bags presents a less appealing appearance to consumers and increases material costs.

A method presently known to encase a chicken in a very tight bag without distortion of the printed material is to shrink the bag with heat after the chicken is in the bag. This method requires specialized, expensive wrapping material.

Accordingly, there is a need for an apparatus and method of encasing material such as poultry, including whole dressed birds, whole dressed birds on trays, and cut-up parts on trays, to provide a pleasing appearance to consumers, to prevent "leakers", to lower costs, and to provide and maintain printing on the packaging.

OBJECTS AND SUMMARY OF THE INVENTION

A general object of the present invention is to provide a method and apparatus for encasing materials tightly in plastic bags, in order to present a more pleasing appearance to consumers.

Another object of the present invention is to provide a method and apparatus to encase materials in a well-sealed package.

Another object of the present invention is to minimize the amount of packaging material needed to encase an object.

Another object of the present invention is to minimize the cost of packaging material.

Another object of the present invention is to limit distortion of printed material on the packaging when encasing material.

Briefly, and in accordance with the foregoing, the present invention discloses an apparatus and a method to stretch a plastic bag, insert material such as a whole chicken, a whole chicken on a tray, or cut-up chicken parts on a tray, into the bag, and eject the material and bag from the apparatus for clipping to seal the bag. The apparatus and method of stretching the bag before inserting the chicken allow the bag to contract around the material and therefore encase the material very tightly. The apparatus and method accomplish this purpose, and allow for encasing not just whole birds but also material on trays, such as either whole birds or cut-up parts. The use of a plastic bag with a clip closure provides for a very tight seal. Additionally, smaller bags can be used, allowing for lower material cost. Finally, the use of plastic bags with a memory agent allows the plastic to expand and then contract around the material very tightly and very evenly Because the bags contain a memory agent and are stretched evenly, they will contract back around the material with minimal distortion of the printed information on the bag.

BRIEF DESCRIPTION OF THE DRAWINGS

The organization and manner of the structure and operation of the invention, together with further objects and advantages thereof, may best be understood by reference to the following description, taken in connection with the accompanying drawings.

DETAILED DESCRIPTION OF THE ILLUSTRATED EMBODIMENT

Figure 1:
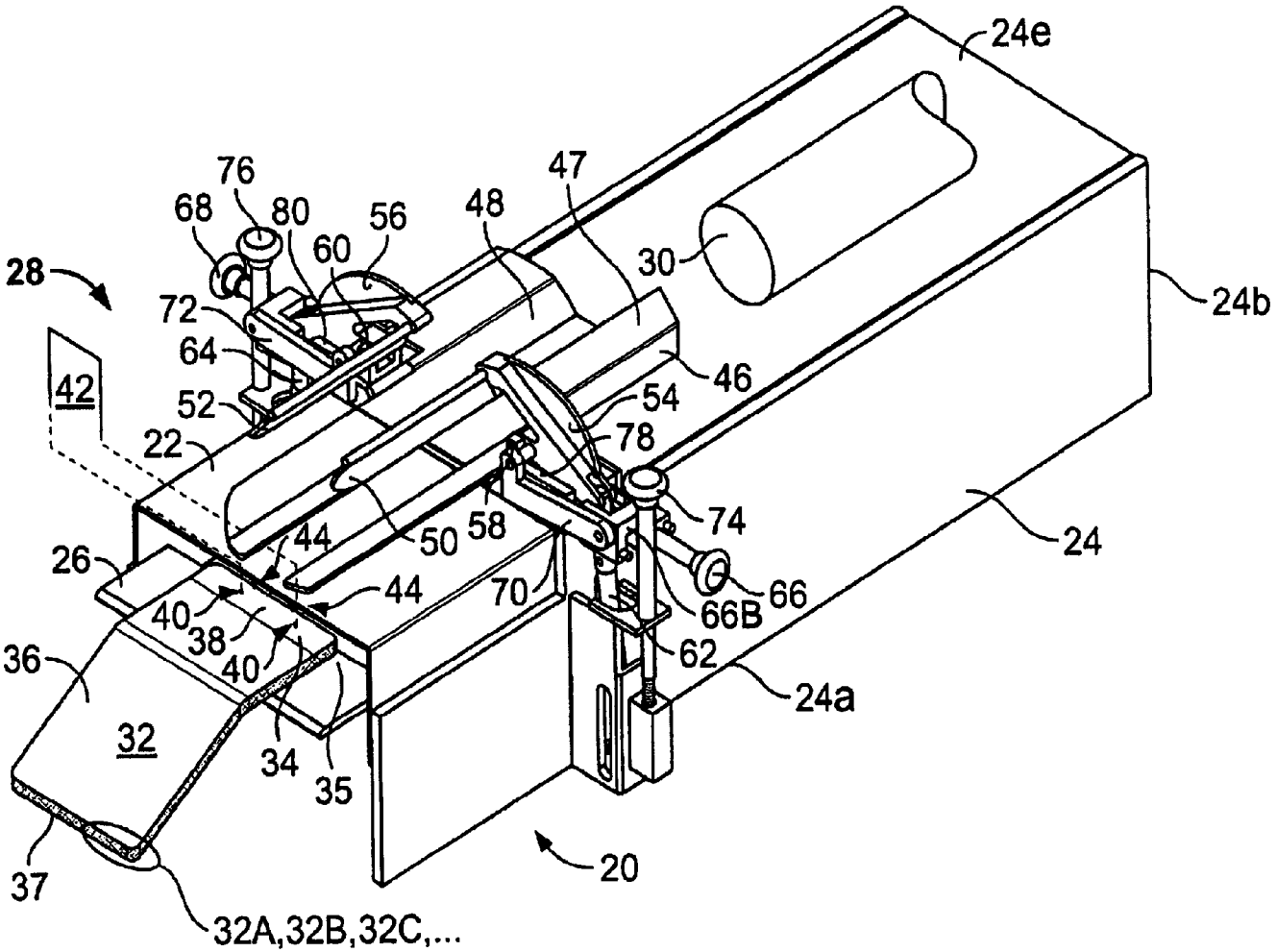
FIG. 1 is a perspective view of the bagger apparatus.

While the invention may be susceptible to embodiments in different forms, there is shown in the drawings, and herein will be described in detail, a specific embodiment with the understanding that the present disclosure is to be considered an exemplification of the principles of the invention, and is not intended to limit the invention to that as illustrated and described herein. For example, the present disclosure describes the method and apparatus as used to encase chickens and chicken parts, but the same method and apparatus can be used for other poultry and for other material without departure from the invention.

Figure 2:
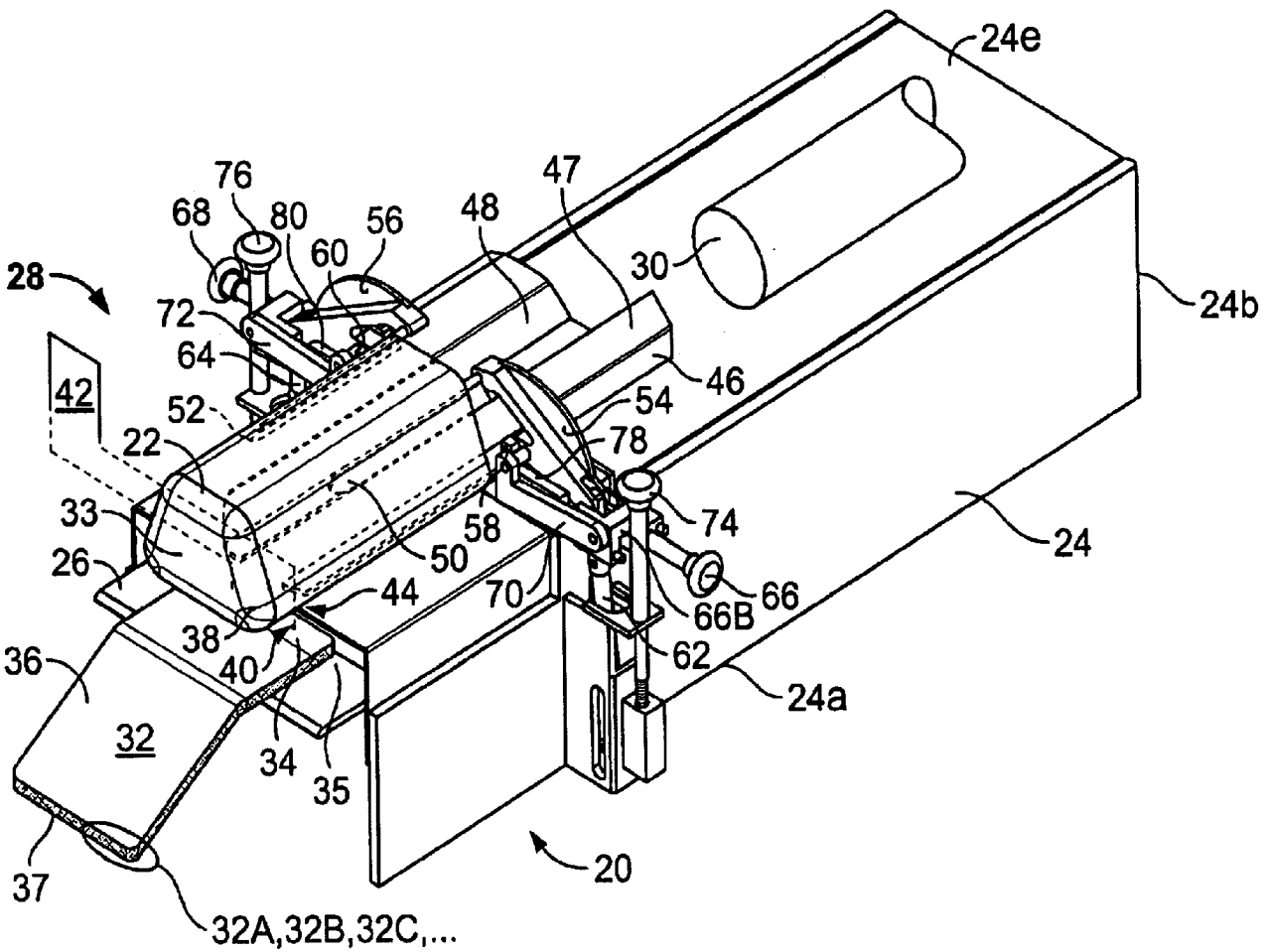
FIG. 2 is a perspective view of the apparatus show in FIG. 1, along with a bag stretched and ready to receive material.

A perspective view of an apparatus 20 is shown in FIGS. 1 and 2. The apparatus 20 includes a rigid frame 24 having a front 24*a*, a rear 24*b*, a left side 24*c*, a right side 24*d*, and a top 24*e*. Please note that in the preferred embodiment, the rigid frame 24 as well as all other components of the apparatus 20 are made of stainless steel for ease of cleaning, but any material can be used.

A bag carriage 22 is located at the rear of the rigid frame 24. The bag carriage 22 is shaped, in cross-section, like an inverted "U". It has a flat horizontal surface 22*a*, and two sides 22*b* and 22*c* extending downward. The sides 22*b* and 22*c* ride on rails (not shown) on the inside of the rigid frame 24, but any means of attachment can be used, so that the bag carriage 22 slides inside the rigid frame 24 from the rear 24*b* towards the front 24*a* and back again. Additionally, the bag carriage 22 has two air jets 44 located under its horizontal surface and facing to the rear of the rigid frame 24. These air jets 44 are connected to a standard compressed air supply (not shown).

The bag carriage 22 preferably includes a bag platform 26. The bag platform 26 is generally rectangular in shape and is mounted so that the rear edge of the bag platform 26 is positioned under the horizontal surface 22*a* of the bag carriage 22. The bag platform 26 is attached to the bag carriage 22 by any suitable means (not shown) so that the bag platform 26 travels front 24*a* to rear 24*b* along with the bag carriage 22. Additionally, however, the bag platform 26 has means, not shown, to raise it and lower it independently between its first, lower position and a second, raised position. Any suitable hydraulic or mechanical system can be used to accomplish this raising and lowering. The upward movement of the bag platform 26 is stopped by the airjets 44 located at the underside of the horizontal surface 22*a* of the bag carriage 22. The bag platform 26 includes two apertures, not shown, in its flat horizontal surface for attaching a stack of bags 32.

As shown in FIG. 1, a stack of bags 32 includes bags 32A, 32B, 32C, etc. Each bag 32A, 32B, 32C, etc. includes a bottom 34, a top 36, a front end 35 and a rear end 37. The bottom extends beyond the top 36, creating an opening 38. Two apertures 40 are provided through the bottom 34 near the front end 35 of the bags 32A, 32B, 32C, etc. When the stack of bags 32 is place on the bag platform 26, the apertures 40 in the stack of bags 32 align with the apertures in the bag platform 26. An inverted unshaped wicket 42 is provided for mounting the stack of bags 32 on the bag platform 26. The stack of bags 32 is mounted to the bag platform 26 by passing the ends of the wicket through the apertures 40 and through the apertures in the bag platform 26 and then securing the ends of the wicket 42 under the bag platform 26, such as by twisting the ends of the wicket together, bolting the ends, or any other suitable method of attaching the wicket 42 to the bag platform 26.

A bag-stretching unit 28 has left-side and right-side components, including a left base guide 46, a right base guide 48, a left finger 50, a right finger 52, a left arm 54, and a right arm 56. The relation of the left and right components to each other and to the rigid frame 24 can be adjusted.

As shown in FIGS. 1 and 3, a left sizer 66 includes a left screw adjuster 66A, a left sizer mount 66B, and a left bracket 70. The left screw adjuster 66A is connected to the rigid frame 24, so that rotation of the left screw adjuster 66A causes it to move toward the left 24*c* or the right 24*d* relative to the rigid frame 24. The left sizer mount 66B is connected to the left screw adjuster 66A so that the left screw adjuster 66A rotates within the left sizer mount 66B, but moves the left sizer mount 66B toward the left 24*c* or the right 24*d* of the rigid frame 24 as the left screw adjuster 66A moves. The left sizer mount 66B is attached to the left bracket 70, which is connected to a left arm 54. The left arm 54 is adjusted toward the left 24*c* or the right 24 of the rigid frame 24 as hereinafter described, by rotation of the left screw adjuster 66A.

Similarly, a right sizer 68 includes a right screw adjuster 68A, a right sizer mount 68B, and a right bracket 72. The right screw adjuster 68A is connected to the rigid frame 24, so that rotation of the right screw adjuster 68A causes it to move toward the left 24*c* or the right 24*d* relative to the rigid frame 24. The right sizer mount 68B is connected to the right screw adjuster 68A so that the right screw adjuster 68A rotates within the right sizer mount 68B, but moves the right sizer mount 68B toward the left 24*c* or the right 24*d* of the rigid frame 24 as the right screw adjuster 66A moves. The right sizer mount 68B is attached to the right bracket 72, which is connected to a right arm 56. The right arm 56 is adjusted toward the left 24*c* or the right 24 of the rigid frame 24 as hereinafter described, by rotation of the right screw adjuster 68A.

In the preferred embodiment, the adjustable sizers 66 and 68 are screw-type adjusters. However, any kind of adjusting mechanism can be used to adjust the distance between the left arm 54 and the right arm 56. In the preferred embodiment the user can adjust the distance, grossly or finely, between the right arm 56 and the left arm 54 to allow for differences in sizes of trays, variations in sizes of bags, variations in sizes of material to be bagged and variations in stretchability of bags from different vendors or suppliers.

A left height adjuster 74 is connected to the frame 24 and to the left piston 62. A right height adjuster 76 is connected to the frame 24 and to the right piston 64. The height of the left piston 62 is adjusted by rotating the left height adjuster 74 and the height of the right piston 64 is adjusted by rotating the right height adjuster 76. By adjusting the height of the left piston 62, which articulates with the left arm 54, the user can adjust the degrees of arc through which the left arm 54 travels, thereby adjusting the height to which the left finger 50 will reach. Similarly, by adjusting the height of the right piston 64, which articulates with the right arm 56, the user can adjust the degrees of arc through which the right arm 56 travels, thereby adjusting the height to which the right finger 52 will reach. In the preferred embodiment, the left and right height adjusters 74, 76 are screw-type adjusters but any type of height adjustment can be done without departing from the spirit of the invention.

The left arm 54 connects to a left mounting bracket 78, and rotates about a left axle 58. The left mounting bracket 78 is connected to the frame 24. Similarly the right arm 56 connects to a right mounting bracket 80, and rotates about a right axle 60. The right mounting bracket 80 is connected to the frame 24.

Figure 3A:
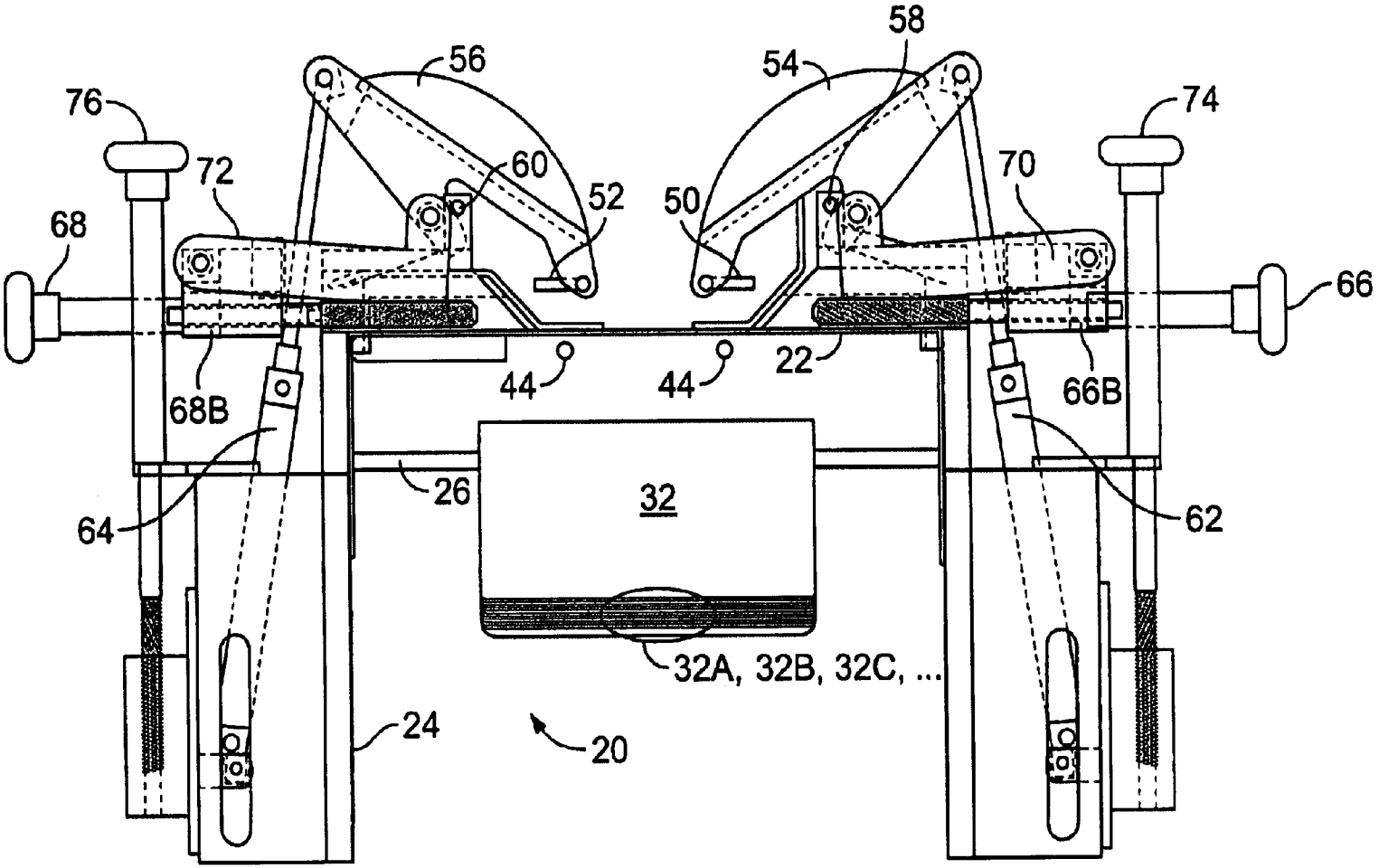
FIG. 3A is an elevation view of the bagger apparatus showing the arms of the bag stretching unit in a first position.
Figure 3B:
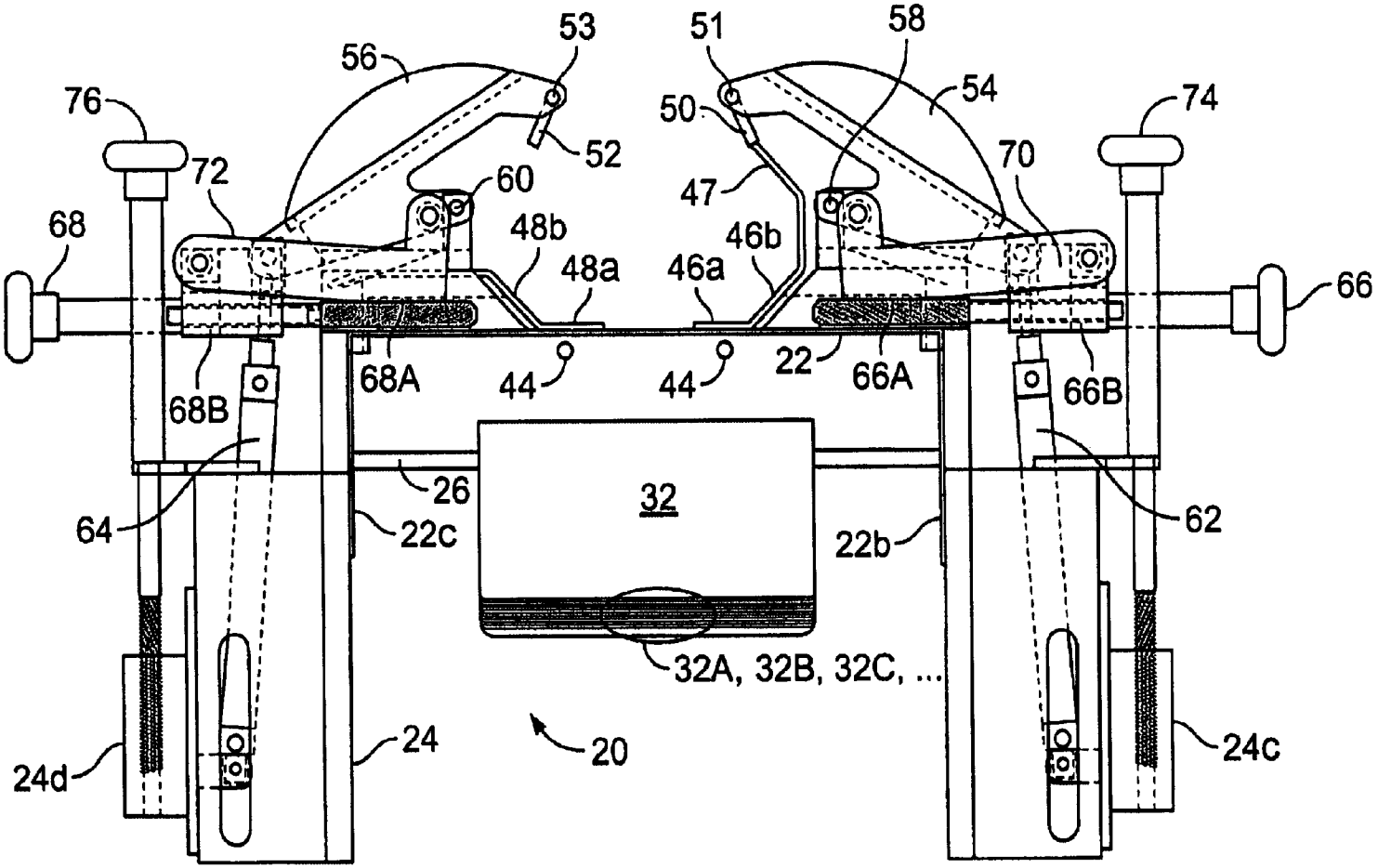
FIG. 3B is an elevation view of the bagger apparatus showing the arms of the bag stretching unit in a second position.

The left adjustable base guide 46 is an elongated member, with an angled cross-section. The left adjustable base guide 46 is positioned above the frame 24, is essentially parallel to the top surface of the frame 24, and extends from near the front of the frame 24 to beyond the rear of the frame 24. As shown in FIGS. 3A and 3B, 3, the base guide 46 includes a lower portion 46*a* and an upper portion 46*b*. The upper portion 46*b* slants upward and outward toward the left 24*c* of the frame 24. The left adjustable base guide 46 also includes a stopping plate 47. The stopping plate 47 includes a lower portion 47*a* and an upper portion 47*b*. The lower portion 47*a* extends upward from the left adjustable base guide 46. The upper portion 47*b* extends upward and inward from the lower portion 47*a*. The stopping plate 47 extends along a portion of the left adjustable base guide 46.

The right adjustable base guide 48 is an elongated member, with an angled cross-section. The right adjustable base guide 48 is positioned above the frame 24, is essentially parallel to the top surface of the frame 24, and extends from near the front of the frame 24 to beyond the rear of the frame 24. As shown in FIGS. 3A and 3B, 3, the base guide 48 includes a lower portion 48*a* and an upper portion 48*b*. The upper portion slants upward and outward toward the right 24*d* of the frame 24.

All edges of both the left adjustable base guide 46 and the right adjustable base guide 48 are rounded to allow plastic to slide over those edges. Additionally, the rear ends of the base guides 46 and 48 are tapered for the same purpose.

A left finger 50 is pivotally attached to the left arm 54 through a rod 51. A right finger 52 is pivotally attached to the right arm 56 through a rod 53. The left finger 50 and the right finger 52 are elongated members that extend rearward of the left arm 54 and the right arm 56, respectively. Each finger 50, 52 is generally rectangular in cross-section. The edges of each finger 50, 52, however, are rounded to allow plastic to slide over those edges more easily. Additionally, the round rods 51, 53 provide a rounded surface which will also contact the plastic during the stretching process to be hereinafter described. Both fingers 50 and 52 are tapered at their rear ends.

Figure 4:
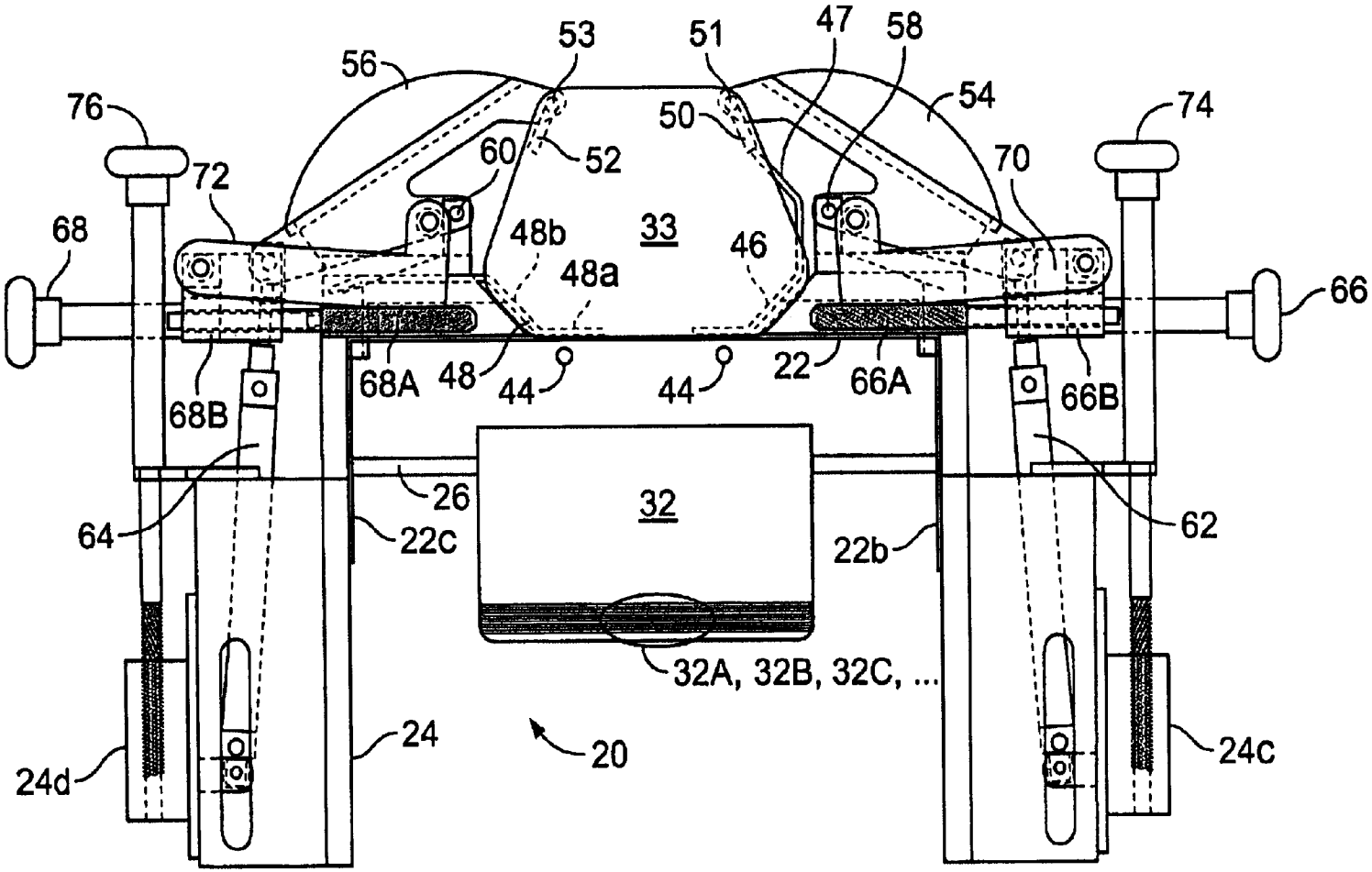
FIG. 4 is an elevation view of the apparatus shown in FIG. 3B, along with a bag stretched and ready to receive material.
Figure 5:
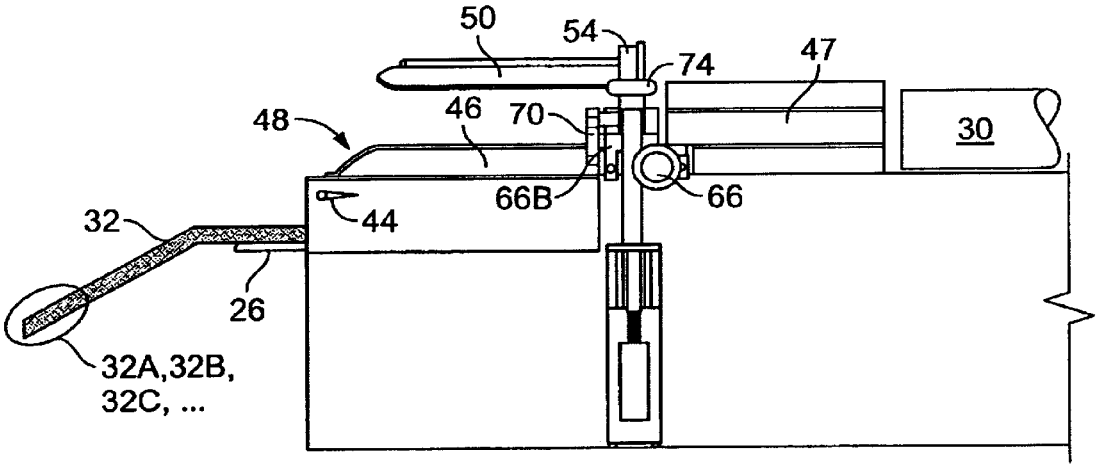
FIG. 5 is a side elevation view of the bagger apparatus.

The left finger 50 and right finger 52 are mounted on the mounting arms 54 and 56 so that the fingers 50 and 52 fit between the base guides 46, 48 when in a first position, as shown in FIG. 3A. When the mounting arms 54 and 56 rotate, as hereinafter described, the fingers 50 and 52 move upward and outward to a second position. In this second position, the flat sides of the fingers 50 and 52 point downward and outward toward the outer edges of the left and right adjustable base guides 46 and 48, respectively. Accordingly, as shown in FIGS. 2 and 4, the cross-section of the bag 32A, when it is stretched around the fingers 50, 52 and the base guides 46, 48, forms a hexagon which can be adjusted to approximate the cross-section of the material to be packaged, allowing for the use of a minimally-sized bag 32A and thereby saving material costs.

A ram 30 is positioned near the front of the apparatus 20. The ram 30 is aligned such that upon activation the ram will move forward between the base guides 46 and 48. The ram 30 is oriented so that it operates midway between the left adjustable base guide 46 and the right adjustable base guide 48. The ram 30, in the preferred embodiment, is an air piston.

Operation of the apparatus will now be described. To begin the size of the bag to be packed is selected. The size of the bag to be used will be determined in part by the size of the item to be placed in the bag, and the ability of the bag to stretch. The size of the bag 32A is selected to form a very tight wrap around the material to be encased. In the preferred embodiment, a 7.25-inch bag forms a very tight wrap around a standard whole dressed chicken sold in the poultry industry. Different sized bags can be used for different sizes of poultry, different sizes of trays, or different material altogether. A stack of bags 32 of a preselected size is then loaded on the bag platform 26 using the wicket 42.

Next, the distance between the left base guide 46 and the right base guide 48 is adjusted using the left sizer 66 and the right sizer 68. The base guides 46, 48 are designed to accommodate either a tray or a whole bird. The angular cross-section allows a tray, containing either a whole bird or cut-up parts, to slide on and between the base guides 46, 48. The design of the guides also permits a whole bird to slide on and between the guides 46, 48. The height of the left and right arms 54, 56 is adjusted using the left and right height adjusters 74, 76, so that, when the arms 54, 56 are raised to a second position as hereinafter described, the fingers 50, 52 will be in a second position slightly above the height of the material to be packaged.

The arms 54, 56 begin in a first position. In this first position, the pistons 62, 64 are at extension, causing the arms 54, 56 to be rotated inward, causing the fingers 50, 52 to move downward and inward.

The bag carriage 22 begins in a first position in which the front 35 of the bag 32A is positioned slightly rearward of the base guides 46, 48. The bag platform 26 is raised from a first position to a second position. In the second position, the stack of bags 32 contacts the air jets 44 at the point of the opening 38 of the top-most bag 32A. At this point the top-most bag 32A is now at nearly the same height as the bag carriage 22. Air is forced through the jets 44 to lift the top 36 of the first bag 32A above the left and right base guides 46, 48. Next the bag carriage 22 is moved forward, allowing the left base guide 46 and the right base guide 48 to pass over bottom 34 of the bag 32A and through the opening 38 of the bag 32A. As the bag carriage 22 moves, the top 36 of bag 32A slides over the left base guide 46, the right base guide 48, the left finger 50, and the right finger 52, the latter two of which are, at this time, in a first position wherein the left finger 50 and the right finger 52 are generally positioned between two base guides 46 and 48. The bag carriage 22 will continue to be moved forward to a second position until the base guides 46, 48 reach the rear end 37 of the bag 32A. Other devices, such as suction cups or a mechanical device, could also be used for opening the bag 32A.

Figure 6:
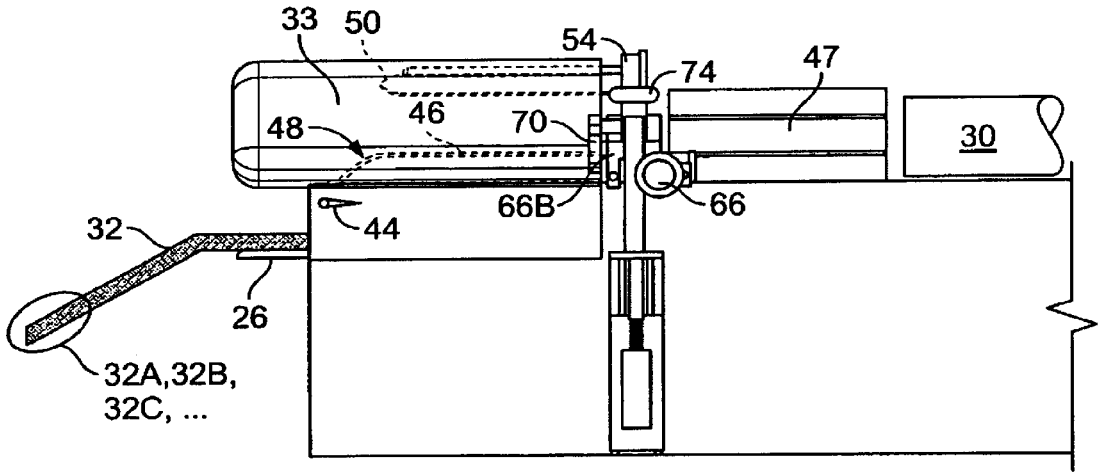
FIG. 6 is a side elevation view of the apparatus shown in FIG. 5, along with a bag stretched and ready to receive material.

The pistons 62, 64 then retract to pull down on the arms 54, 56, causing the arms 54, 56 to rotate about their axles 58, 60. In turn, the fingers 50, 52 move upward and outward until the fingers 50, 52 reach a second position. The second position of the fingers 50, 52, which was preset as described above, was selected so that the fingers 50, 52 are positioned slightly above the top of the material to be packaged. The rotation of the arms 54, 56, by moving the fingers 50, 52 rotationally through arcs, causes the bag 32A to stretch evenly about its circumference. The bag 32A is now stretched and ready to receive material as shown in FIGS. 2, 4, and 6. At this point, the bag platform 26 drops a short distance to its first position, thereby tearing the now-stretched bag 32A off the wicket 42. What was the second bag 32B on the stack of bags 32 is now on top of the stack of bags 32. The bag carriage 22 returns to its first position, talking the bag platform 26 (still in its first position) along.

The item to be packed, for example, a whole dressed chicken or chicken parts on a tray, is placed on and between the base guides 46, 48. In the preferred embodiment, the item will be loaded from the right side of the apparatus. The stopping plate 47, mounted on the left side of the apparatus, will prevent the material from going over the edge of the left base guide 46. The apparatus 20 may be used as part of an automated system, for example, one in which trays of items are conveyed automatically to the location between the base guides 46 and 48. In the event that material is misguided by a user or a conveyor, and misses the intended area between the base guides 46, 48, the stopping plate 47 will retain the material and prevent it from going over the side of the base guide 46.

The ram 30 pushes the material into the now-stretched bag 32A. Continuation of the movement of the ram 30 pushes the material and bag 32A off the base guides 46, 48 and the fingers 50, 52. As the bag 32A comes off the base guides 46, 48 and the stretching fingers 50, 52, the stretched plastic contracts back to its original size, and contracts around the material in the bag 32A. Because the plastic contains memory agent, the plastic will contract with minimal distortion of any printed information on the bag 32A. The contraction of the plastic will cause the bag 32A to wrap very tightly around the material, presenting the tight appearance that is pleasing to consumers and thereby conferring a marketing advantage upon products packaged by this method.

In the preferred embodiment, as the ram 30 pushes the now-encased material out the rear of the apparatus 20, it falls onto a conveyor belt (not shown), which carries the bagged material down the line for closure and clipping of the bag to form a tight seal. The now-encased material can be handled manually or by other mechanical methods.

When the bag carriage 22 moves horizontally to its original position, the bag support platform 26 also moves horizontally back to its original position also. The apparatus 20 is now ready for the next cycle. The ram then returns to its original position.

In the preferred embodiment, 7.25-inch bags can be used for standard whole birds instead of the 8.75-inch bags formerly used in the poultry industry, at a cost savings of approximately 15 percent. Because of the adjusting mechanisms, the apparatus 20 and method can be used for any size material with any suitably-sized bags.

The addition of a memory agent to polyethylene has been found to allow the plastic to expand in the stretching process and then to contract back around the encased material with minimal distortion. The use of polyethylene bags with three to six percent ethylene vinyl acetate (EVA) has been found to provide the best memory and therefore the least distortion of printed matter, but any suitable memory agent that meets this function will suffice.

While a preferred embodiment of the present invention is shown and described, it is envisioned that those skilled in the art may devise various modifications of the present invention without departing from the spirit and scope of the appended claims.

The invention claimed is:

1. An apparatus for stretching a bag, comprising:

a bag, a frame having a left side and a right side, a left base guide projecting from said left side of said frame, said left base guide comprising a base element and a side element, said base element and said side element forming an angle greater than 90 degrees, a right base guide projecting from said right side of said frame, said right base guide comprising a base element and a side element, said base element and said side element forming an angle greater than 90 degrees, a right finger attached to said frame and rotating in an arc from a first position between said left base guide and said right base guide, to a second position above said right base guide, and a left finger attached to said frame and rotating in an are from a first position between said left base guide and said right base guide, to a second position above said left base guide and a point of said left side element farthest from said centerline, whereby rotation of said right finger from said right finger first position to said right finger second position and rotation of said left finger from said left finger first position to said left finger second position, stretches said bag placed over said left base guide, said right base guide, said left finger, and said right finger, to form a cross-section of a hexagon.

2. The apparatus of claim 1, further comprising means to adjust a distance between said left base guide and said right base guide.

3. The apparatus of claim 1, whereby said bag contains means for remembering a size of said bag.

4. The apparatus of claim 3, wherein said means for remembering comprises ethylene vinyl acetate.

5. The apparatus of claim 1, wherein said bag displays preprinted information.

6. A apparatus for placing material in a bag, comprising:

a bag, a frame having a left side and a right side, a left base guide projecting from said left side of said frame, said left base guide comprising a base element and a side element, said base element and said side element forming an angle greater than 90 degrees, a right base guide projecting from said right side of said frame, said right base guide comprising a base element and a side element, said base element and said side element forming an angle greater than 90 degrees, a right finger attached to said frame and rotating in an arc from a first position between said left base guide and said right base guide, to a second position above said right base guide, a left finger attached to said frame and rotating in an arc from a first position between said left base guide and said right base guide, to a second position above said left base guide, whereby rotation of said right finger from said right finger first position to said right finger second position and rotation of said left finger from said left finger first position to said left finger second position, stretches said bag placed over said left base guide, said right base guide, said left finger, and said right finger, to form a cross-section of a hexagon, and means to move material into said stretched bag.

7. The apparatus of claim 6, wherein said means to move comprises a ram.

8. The apparatus of claim 7, wherein said means to move comprises an air-actuated piston.

9. The apparatus of claim 6, further comprising a bag carriage unit and wherein said bag is the top one of a plurality of bags mounted on said bag carriage unit.

10. The apparatus of claim 9, wherein said bag carriage unit moves relative to said frame.

11. The apparatus of claim 6, further comprising means to adjust a distance between said left base guide and said right base guide.

12. The apparatus of claim 6, further comprising a stop plate mounted to said frame.

13. The apparatus of claim 6, wherein said means to move pushes said material against said bag, and said material and said bag move off said left base guide, said right base guide, said left finger, and said right finger, whereby said bag relaxes around said material.

14. The apparatus of claim 13, further comprising means to close said bag.

15. The apparatus of claim 6, whereby said bag contains means for remembering a size of said bag.

16. The apparatus of claim 15, wherein said means for remembering comprises ethylene vinyl acetate.

17. The apparatus of claim 6, wherein said bag displays preprinted information.

18. A method for stretching a bag, comprising placing a bag, said bag having a relaxed state, a tightly stretched state, and an intermediate stretched state, over a right base guide, a left base guide, a right finger, and a left finger, while said bag is in said relaxed state, whereby said left base guide comprises a base element and a side element, said base element and said side element forming an angle greater than 90 degrees, whereby said right base guide comprises a base element and a side element, said base element and said side element forming an angle greater than 90 degrees, and whereby said left base guide and said right base guide are oriented a distance apart, rotating said right finger in an arc from a first position between said left base guide and said right base guide, to a second position above said right base guide, rotating said left finger in an arc from a first position between said left base guide and said right base guide, to a second position above said left base guide, whereby rotation of said right finger from said right finger first position to said right finger second position and rotation of said left finger from said left finger first position to said left finger second position, stretches said bag over said left base guide, said right base guide, said left finger, and said right finger, to form a cross-section of a hexagon.

19. The method of claim 18, whereby said bag contains means for remembering a size of said bag.

20. The method of claim 19, wherein said means for remembering comprises ethylene vinyl acetate.

21. The method of claim 18, further comprising the step of preprinting information on said bag.

22. A method of placing material in a bag, comprising placing a bag, said bag having a relaxed state, a tightly stretched state, and an intermediate stretched state, over a right base guide, a left base guide, a right finger, and a left finger, while said bag is in said relaxed state, whereby said left base guide comprises a base element and a side element, said base element and said side element forming an angle greater than 90 degrees, whereby said right base guide comprises a base element and a side element, said base element and said side element forming an angle greater than 90 degrees, and whereby said left base guide and said right base guide are oriented a distance apart, rotating said right finger in an arc from a first position between said left base guide and said right base guide, to a second position above said right base guide, rotating said left finger in an arc from a first position between said left base guide and said right base guide, to a second position above said left base guide, whereby rotation of said right finger from said right finger first position to said right finger second position and rotation of said left finger from said left finger first position to said left finger second position, stretches said bag over said left base guide, said right base guide, said left finger, and said right finger, to said tightly stretched state, to form a cross-section of a hexagon, and moving said material into said bag in said tightly stretched state.

23. The method of claim 22, further comprising moving said material against said bag so that said bag slides off said left base guide, said right base guide, said left finger, and said right finger, whereby said bag relaxes to said intermediate stretched state around said material.

24. The method of claim 23, further comprising closing said bag.

25. The method of claim 24, whereby said bag contains means for remembering a size of said bag.

26. The method of claim 25, wherein said means for remembering comprises ethylene vinyl acetate.

27. The method of claim 24, further comprising the step of preprinting information on said bag.

* * * * *

UNITED STATES PATENT AND TRADEMARK OFFICE

CERTIFICATE OF CORRECTION

PATENT NO. : 6,895,726 B2
DATED : May 24, 2005
INVENTOR(S) : Robert Pinto and Eggo L. Haschke It is certified that error appears in the above-identified patent and that said Letters Patent is hereby corrected as shown below:

Column 4,
Line 14, "bottom" should be -- bottom 34 --

Column 8,
Line 36, "are" should be -- arc --

Signed and Sealed this

Twenty-sixth Day of July, 2005

JON W. DUDAS
*Director of the United States Patent and Trademark Office*